US006202320B1

(12) United States Patent
Chow

(10) Patent No.: US 6,202,320 B1
(45) Date of Patent: Mar. 20, 2001

(54) METHOD OF LUMBER PREPARATION TO IMPROVE DRYING AND DEVELOPMENT OF A NEW ENGINEERED WOOD COMPOSITE

(76) Inventor: Suezone Chow, 10351 Bamberton Drive, Richmond, British Columbia (CA), V7A 1K6

( * ) Notice: Subject to any disclaimer, the term of this patent is extended or adjusted under 35 U.S.C. 154(b) by 0 days.

(21) Appl. No.: 09/434,772

(22) Filed: Nov. 4, 1999

(30) Foreign Application Priority Data

Jun. 3, 1999 (CA) ..... 2273541

(51) Int. Cl.[7] ..... F26B 7/00

(52) U.S. Cl. ..... 34/381; 34/383; 34/389; 52/514

(58) Field of Search ..... 34/381, 383, 389, 34/396, 459, 518; 52/514, 514.5, 742.1

(56) References Cited

U.S. PATENT DOCUMENTS

| | | | | |
|---|---|---|---|---|
| 4,894,971 | | 1/1990 | Cortese | 52/514 |
| 4,916,629 | | 4/1990 | Bogue et al. | 364/507 |
| 4,941,305 | * | 7/1990 | Cortese | 52/514 |
| 4,984,172 | | 1/1991 | Luminari | 364/478 |
| 5,014,483 | | 5/1991 | Southern | 52/514 |
| 5,075,131 | | 12/1991 | Hattori et al. | 427/45.1 |
| 5,097,881 | | 3/1992 | Mack | 144/356 |
| 5,412,220 | | 5/1995 | Moore | 250/563 |
| 5,440,859 | | 8/1995 | Cortese | 52/742 |
| 5,585,732 | | 12/1996 | Steele et al. | 324/663 |
| 5,674,338 | * | 10/1997 | Parker et al. | 156/98 |
| 5,927,359 | * | 7/1999 | Kersten | 144/347 |

FOREIGN PATENT DOCUMENTS

| | | |
|---|---|---|
| 2120590 | 4/1994 | (CA) . |
| 2001289 | 10/1998 | (CA) . |

* cited by examiner

*Primary Examiner*—Pamela Wilson
(74) *Attorney, Agent, or Firm*—Kolisch Hartwell Dickinson McCormack & Heuser

(57) ABSTRACT

A method of treating a piece of lumber including the steps of a) analyzing the lumber to detect a surface defect at a site on the lumber; b) removing at least a portion of the surface defect to form an opening in the lumber at the site of the defect; c) drying the lumber using a process wherein moisture is allowed to escape from the lumber through the opening; and, d) inserting a solid plug in the opening to refill the opening in the lumber.

18 Claims, 3 Drawing Sheets

Flexural Properties of Dowel-Reinforced Edge-Glued Panels Bonded with PRF
Load vs. Deformation

METHOD OF LUMBER PREPARATION TO IMPROVE DRYING AND DEVELOPMENT OF A NEW ENGINEERED WOOD COMPOSITE

FIELD OF THE INVENTION

The invention is in the field of processes for lumber treatment, including defect removal, drying and joining.

BACKGROUND OF THE INVENTION

Wood is hydroscopic, which means that it shrinks or swells with changes in its moisture content (MC). Freshly cut green lumber generally shrinks as its moisture content falls over time. Before lumber is used for construction, it is therefore usually desireable to dry the wood to a moisture content that will be relatively stable during the service life of the lumber in a particular structure, to minimize changes in the size of the lumber after it is used in construction. Drying may also be a desireable step in the preparation of engineered wood composits or other wood products, or as preparatory step prior to impregantion of a wood product with compounds such as preservatives or fire retardants.

Drying lumber before placing it in service may have a number of advantages, including: providing dimensional stability; increasing strength and mechanical fastener holding power; reducing subsequent drying-related damage such as splitting and checking; decreasing susceptibility to biological stain, decay and insect attack; improving the capacity of wood to hold paint and other coatings; and reducing the weight of wood with a resulting decrease in shipping and handling costs.

There are a number of factors that affect the process of drying lumber, including the species of tree, lumber size, structural direction of wood, drying method, and method of lumber preparation. The interrelationship of these factors may be complex. For example, the moisture content of sapwood lumber is usually considerably higher than heartwood. However, this variation in initial moisture content may be offset in the drying process by the fact that sapwood has a higher permeability than heartwood. In green lumber, it is possible to detect moisture content variations between species, from pith to bark and at different height levels. For example, differences among spruce, pine, and alpine fir trees may include variability in the percentage of sapwood content between species, variability in the moisture content of the sapwood between species, variability in the heartwood moisture content between species and variability in moisture content single log from the sapwood-heartwood boundary to the pith region (dependednt in part on the tree height). Exemplary data gathered from pine and alpine fir trees at different height levels, and on various spruce and alpine fir logs of different diamenters, shows the sapwood contents as given in Tables 1a and 1b, respectively.

TABLE 1a

Sapwood/Heartwood Ratio (%) for Spruce-Pine-Fir Trees at Varying Height Levels

| Tree Height (ft) | Alpine Fir | Spruce | Pine |
|---|---|---|---|
| 0 | 19.5 | 30.5 | 24.0 |
| 8 | 16.5 | 29.5 | 22.0 |
| 16 | 18.5 | 26.5 | 22.0 |
| 24 | 18.0 | 25.5 | 29.0 |

TABLE 1a-continued

Sapwood/Heartwood Ratio (%) for Spruce-Pine-Fir Trees at Varying Height Levels

| Tree Height (ft) | Alpine Fir | Spruce | Pine |
|---|---|---|---|
| 32 | 20.5 | 24.0 | 29.0 |
| 40 | 22.5 | 25.5 | 31.0 |
| 48 | 31.0 | 28.0 | 28.0 |
| 56 | | 35.5 | 34.0 |
| 64 | | | 42.0 |
| 72 | | | 58.0 |
| 80 | | | 71.0 |
| Average | 20.9 | 28.1 | 35.5 |

TABLE 1b

Sapwood Content of Various Randomly Selected Spruce and Alpine Fir Logs

| | Spruce | | Alpine Fir | |
|---|---|---|---|---|
| | Diameter (in) | Sapwood Content (%) | Diameter (in) | Sapwood Content (%) |
| | 8.0 | 20.4 | 12.8 | 15.0 |
| | 7.6 | 41.0 | 8.4 | 23.8 |
| | 7.2 | 30.0 | 10.3 | 17.0 |
| | 5.4 | 28.0 | 12.2 | 12.4 |
| | 8.6 | 45.0 | 15.2 | 10.0 |
| | 5.7 | 19.0 | 9.6 | 12.0 |
| | 5.4 | 34.8 | | |
| | 14.5 | 23.0 | | |
| | 10.8 | 19.6 | | |
| | 9.3 | 21.4 | | |
| | 8.0 | 22.0 | | |
| Average | 8.2 | 27.7 | 11.4 | 15.0 |

A consequence of the wide variability in moisture content and wood drying properties is that drying processes that typically treat large volumes of lumber with a uniform process may give varying results for different parts of the treated lumber. For example, alpine fir dried in a conventional kiln using a typical drying schedule may produce lumber with a variable final moisture content, shown in Table 2, indicating that even if the average moisture content of the lumber was within a selected maximum limit (such as 19%), a large volume of the lumber may still have a moisture content over that limit. For example, in the exemplified data, when the average moisture content was down to 18.6%, it was estimated that about 48% of the lumber still had a moisture content over 19%, and about 78% of the lumber had a moisture content over 12%. This is demonstrative of inefficiencies in conventional drying processes. These inefficiencies may be particularly important in some applications, such as value-added manufacturing of composite wood products, where it is desired to obtain a relatively uniform dryness in each piece of lumber that is to be used for making the composite, so that the parts of the composite have a similar moisture content.

TABLE 2

Moisture Content (MC) of Alpine Fir Lumber at Various Stages of Drying in a Commercial Conventional Kiln

| Drying Time (hr) | Average MC (%) | Approximate Quantity of Lumber Pieces ( MC > 12% | MC > 19% |
|---|---|---|---|
| 32.5 | 32.6 | 95.1 | 86.2 |
| 44.5 | 23.8 | 88.1 | 68.4 |
| 55.0 | 18.6 | 77.6 | 48.2 |
| 74.5 | 10.6 | 38.6 | 4.0 |

Variations in wood structure and permeability, relative proportions of sapwood and heartwood, and differences in specific gravity, original moisture content and moisture distribution, and refractiveness of the wood all contribute to differences in the drying properties of different species. One of the causes of low permeability, as well as large variation in permeability within a species, is the presence of discontinuities in a particular piece of lumber, such as wet pockets or knots.

There are two main structural directions in wood, namely: longitudinal and transverse. The longitudinal direction corresponds to the direction along the stem or trunk of the tree. The long dimension of most cut lumber is along this longitudinal direction of the wood. The transverse direction is perpendicular to the longitudinal direction of the stem. There are two structurally distinct transverse directions in wood, namely: radial and tangential. The radial direction is parallel to the radius of the stem, passing from the bark through the pith perpendicularly to the annual growth rings of the tree. The tangential direction is perpendicular to the radial direction and tangent to the annual growth rings of the tree.

The width and thickness of most cut lumber is along a transverse direction of the wood, the transverse direction typically having a component that is radial and a component that is tangential. These structural directions in wood are important to the drying process because wood is in part composed of elongated water-carrying channels (some of which carry fluids other than water, such as sap, under physiological conditions), most of which are oriented in the longitudinal direction of the stem. The longitudinal orientation of these passageways dictates that lumber is an anisotropic material in which the rate of fluid flow is different in the transverse and longitudinal directions.

Moisture movement in lumber is typically much slower in the transverse direction compared to the longitudinal direction. It has for example been calculated that the diffusion coefficient in the longitudinal direction may be about six times as great as that in the transverse direction (Brown, H. P., A. J. Panshin and C. C. Forsaith. 1952. Textbook of Wood Technology, Vol. II. 1$^{st}$ Ed.). Although moisture movement may be proportionally much more rapid in the longitudinal direction, the usual dimensions of cut lumber dictate that moisture migration in the transverse direction may be more important in conventional drying processes. This can give rise to difficulties in drying thick pieces of lumber, which have relatively large transverse dimensions.

There are a number of known methods for drying lumber, including: air drying, which is a relatively slow process; kiln drying, which uses high temperatures and air circulation to increase the drying rate; radio frequency/vacuum drying, in which the wood is heated by radio frequency irradiation and subjected to vacuum; superheated steam/vacuum drying, in which the lumber is heated with superheated steam. There are drawbacks to some conventional drying methods. For example, in radio frequency drying of lumber with a large longitudinal dimension, internal burning of the wood may occur when portions of the wood reach a relatively low moisture content, while other portions of the wood remain at a relatively high moisture content.

A number of innovative methods have been suggested for improving conventional drying processes. For example, U.S. Pat. No. 5,075,131 to Hattori et al. discloses a method for treatment of wood that includes forming small holes in the surface of the wood to assist in the impregnation of the wood with a preservative and to facilitate drying of the wood. Such methods of introducing very small holes or incisions in the wood may be intended to minimize surface damage, and thereby preserve the aesthetic appearance of the wood, the dimensions of the holes do not readily permit the holes to be refilled, except perhaps with a surface coating. In some applications, the presence of many small holes in the surface of a piece of lumber may be aesthetically undesirable.

The appearance of finished lumber may be improved by removing defects such as knots and knotholes. A wide variety of methods are known for detecting and repairing naturally occuring defects in lumber. For example, U.S. Pat. Nos. 4,894,971 and 5,440,859 disclose methods of replacing defects such as knots with a shaped plug. Automated systems have been suggested for detecting defects such as knots, and using such information to grade lumber or to effect repairs. Examples of such systems are disclosed in U.S. Pat. No. 4,984,172 issued to Luminari in 1991, U.S. Pat. No. 5,412,220 issued to Moore in 1995 and U.S. Pat. No. 5,585,732 issued to Steele et al. in 1996.

SUMMARY OF THE INVENTION

In one aspect, the invention may be adapted to provide a method of treating a piece of lumber including the steps of a) analyzing the lumber to detect a surface defect at a site on the lumber; b) removing at least a portion of the surface defect to form an opening in the lumber at the site of the defect; c) drying the lumber using a process wherein moisture is allowed to escape from the lumber through the opening; and, d) inserting a solid plug in the opening to refill the opening in the lumber.

In some embodiments, the openings in the lumber may be formed so that they bisect water-carrying channels in the lumber. A wide variety of drying processes may be used, as are known in the art. For example, vacuum and/or heat may be applied in the step of drying the lumber, and heating may be by electromagnetic irradiation. The plug may be made out of a wide variety of materials, depending on structural and aesthetic requirements. For example, the plug may be formed from wood, in which case the plug may be inserted so that the direction of the grain of the plug approximately matches the direction of the grain of the lumber. The plug may also be cut from the same piece of lumber, which may assist in matching the appearance of the plug and the surface of the lumber. A plurality of openings may of course be formed in the lumber, and the openings may be preferentially located in regions of the lumber that have a high moisture content relative to other portions of the lumber, so that the drying process tends to evenly dry the lumber. The plugs may be planed, for example in a standard planing mill, so that the plugs are level with a surrounding surface of the lumber. The lumber may be infused with a liquid, such as a preservative, through the openings before the plug is inserted, either before or after the lumber is dried.

Two or more pieces of lumber provided with opening in accordance with the methods of the invention may be joined by a connector inserted into corresponding holes in each of the pieces of lumber, to form a composite wood product.

DETAILED DESCRIPTION OF THE INVENTION

Figure 1:
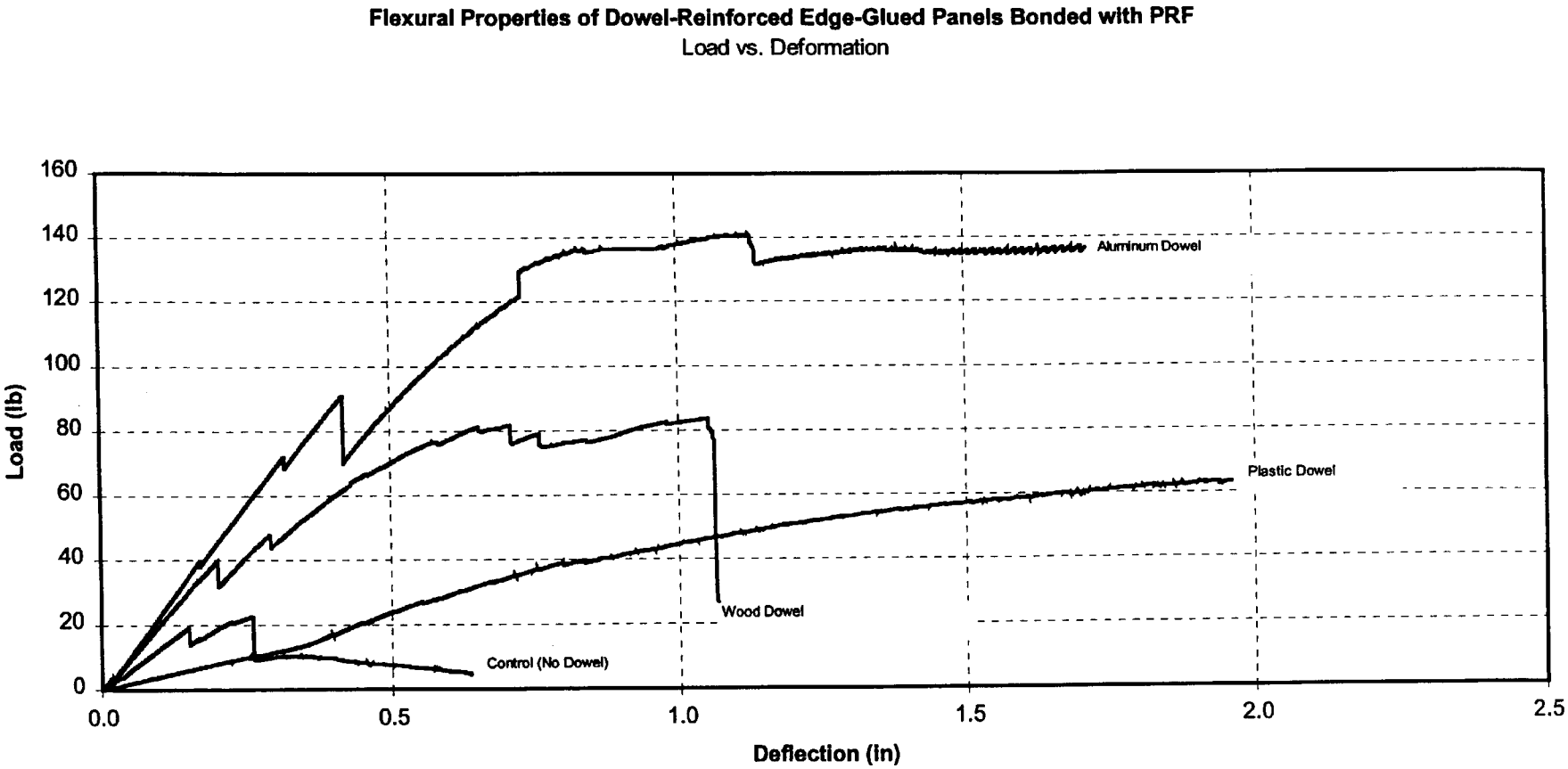
FIG. 1 is a graph showing flexural properties of dowel-reinforced edge-glued panels bonded with PRF, showing load vs. deformation.

In one aspect, the present invention provides methods of treating lumber to improve drying. In preferred embodiments, such methods involve forming openings in the lumber, for example by drilling holes in the lumber. The openings may be of variable size and shape, and are preferentially partly or fully through the transverse direction of the lumber. The opening may be disposed along the longitudinal direction of the lumber, and the frequency of the holes may be varied depending on properties of the wood. The holes preferentially expose internal end-grain regions of the lumber, to facilitate the escape of moisture from the wood. The openings may be spaced to optimize moisture escape under selected drying conditions. The openings are adapted so that they may be refilled once the lumber has been dried. In some embodiments, the holes in the lumber may be refilled with wooden plugs that approximate the appearance of the clear regions of the lumber. In some embodiments, such plugs may be obtained from other portions of the same piece of lumber. The plugs may be oriented on insertion so that they substantially match the direction or grain of the wood. After the plugs are inserted into the lumber, they may be finished by planing to match the surface contour of the adjoining wood. Alternatively, in another aspect of the invention, the plugs or dowels may be used to join separate pieces of lumber, to form a composite wood product. The separate pieces of lumber may also be joined with adhesive, in which case the dowelling may serve to strengthen the composite wood product.

In one aspect of the invention, the plugs that are used to fill the holes in the wood may be oriented so that the grain of the plug matches the grain of the wood. In a preferred embodiment, the plug will be inserted through a transverse surface of the lumber, and the plug will be similarly oriented so that the grain of the plug is not exposed. In a knot, in contrast, the grain typically runs perpendicular to the surface of the wood, so that the knot may act to let moisture into the wood, which may lead to rot (particularly if the knot is not sealed with a surface coating), or the knot may bleed sap that discolours or damages any surface finish on the lumber. The present invention may be adapted in some embodiments to avoid these problems by using appropriately oriented plugs to replace knots.

In one aspect, the invention may include methods of detecting regions of lumber that should preferentially be removed to provide openings that will be located so as to facilitate drying of the lumber. Regions of lumber having relatively high moisture content may for example be identified for preferential removal by measuring the dielectric response of the lumber. Voids and knots may also be detected by sensing the dielectric response of lumber, as disclosed in U.S. Pat. No. 5,585,732 (which is hereby incorporated by reference). Commercial in-line moisture content sensing devices may also be used to identify regions of lumber having relatively high moisture content, so that a larger number of openings, or larger openings, can be made in such regions in accordance with some embodiments of the present invention.

EXAMPLES

Example 1

Effect of Drilled Holes on Lumber Drying at a Controlled Temperature

A comparison was made of the drying rate of 2×4-inch green alpine fir lumber, 4 feet long, with different hole sizes drilled through the narrow face of the lumber. The hole sizes were 0 (control), ¼, ⅜, ½, and ⅝ inch. Five holes were drilled on each piece, 2 inches from each end and three in the middle section spaced 11 inches apart center-to-center. The lumber was end-coated with glue to prevent or minimize moisture loss through the ends. The samples were dried in an oven at 40° C. for 22.9 hours and at 50° C. for 111.5 hours. The weight of the samples was monitored during the drying period.

The results are shown in Table 3. The weight loss was relatively rapid during the first 88 hours of drying, and then tended to level off with further drying. The samples with larger holes (½ and ⅝ inch) showed a more rapid weight loss than those with smaller holes and the control. The weight loss generally increased with increasing hole size. At the end of the drying period, the sample with the ⅝-inch holes showed about 37% greater weight loss than the control. These results demonstrate the enhancement effect of the manufactured holes on the drying of lumber.

TABLE 3

Weight Loss of Alpine Fir Lumber with Varying Hole Size Dried in an Air-Circulation Oven (Holes drilled through narrow face)

| Hole Diameter | Drying Time (hr) | | | | |
|---|---|---|---|---|---|
| (in.) | 16.4 | 22.9 | 88.6 | 94.3 | 111.5 |
| Control | 265.4 | 304.8 | 632.8 | 646.5 | 684.8 |
| ¼ | 331.8 | 374.3 | 746.3 | 759.1 | 794.6 |
| ⅜ | 293.9 | 348.4 | 700.0 | 709.8 | 735.2 |
| ½ | 358.0 | 419.3 | 911.0 | 927.3 | 970.5 |
| ⅝ | 429.6 | 499.3 | 1020.5 | 1036.9 | 1080.9 |

The invention was also exemplified in an embodiment in which the holes were drilled through the wide face of pieces of lumber about 3 feet long. In alternative embodiments, the hole sizes were 0, ⅜, ¾, and 1 inch. Five holes were drilled on each piece, two about 3 inches from each end and three in the middle section spaced 7 inches apart center-to-center. The samples were dried in an oven at 68° C. for 30.7 hours and at 85° C. for 39 hours. The results are shown in Table 4. The trend was similar to that reported in Table 3. The weight loss generally increased with increasing hole size. At the end of the drying period, the sample with the 1-inch hole showed about 11% greater weight loss than the control. These results further demonstrate an enhancement effect of the manufactured holes on lumber drying.

TABLE 4

Weight Loss of Alpine Fir Lumber with Varying Hole Size Dried in an Air - Circulation Oven (Holes drilled through wide face)

| Hole Diameter | Drying Time (hr) | | | | | | | | |
|---|---|---|---|---|---|---|---|---|---|
| | Air Drying | | | Oven Drying | | | | | |
| (in.) | 16.5 | 23.6 | 88.3 | 4.5 | 20.8 | 26.8 | 30.8 | 47.8 | 69.8 |
| Control | 74.17 | 102.68 | 247.55 | 57.03 | 178.20 | 216.93 | 247.85 | 372.43 | 469.70 |
| ⅜ | 61.10 | 87.47 | 271.63 | 78.72 | 235.48 | 278.93 | 317.93 | 454.85 | 536.33 |
| ¾ | 69.13 | 99.03 | 286.75 | 93.48 | 270.43 | 315.55 | 356.50 | 487.60 | 551.90 |
| 1 | 52.43 | 74.03 | 260.03 | 88.88 | 262.28 | 299.75 | 340.25 | 468.43 | 525.98 |

Example 2

Effect of Drilled Holes on Lumber Drying Using Microwave Heating

A comparison was made of the drying rate of drilled and undrilled lumber using microwave heating. The samples comprised 2×3×11.5 inch green alpine fir lumber. In the first test, samples with 0, two, three, and four holes, ¾ inch in diameter, drilled through the wide face were prepared. For the two-hole sample the holes were spaced 3⅞ inches apart, for the three-hole 2⅞ inches apart, and for the four-hole 2 5/16 inches apart, center-to-center at the middle portion. The samples were dried in a Sharp Carousel with ESP Sensor microwave oven. The samples were laid on the narrow face in two layers of two samples per layer. The control and four-hole samples were located at the bottom, and the two-hole and three-hole samples at the top layer. The samples were spaced about 2 inches apart. The drying was continued until the control sample showed signs of burning, ie. emission of smoke. The weight of the samples was monitored every 2–3 minutes throughout the drying period. At the end of the drying period, some samples were sawn in the middle along the grain to examine the characteristic of the interior portion.

The results are shown in Table 5. The drying rate was relatively rapid during the first 40 minutes of drying, and then gradually decreased with further drying. Of the samples located on the bottom layer, the control and four-hole samples, the latter showed a greater drying rate than the former. Likewise, of the samples on the top layer, the three-hole sample showed a greater drying rate than the two-hole sample. At about 40 minutes into the drying period, the four-hole sample showed about 9% greater drying rate than the control. Similarly, the three-hole sample showed about 19% greater drying rate than the two-hole sample. At about 57 minutes of drying, smoke was observed being emitted by the control sample. The interior portion of the control showed distinct charring which was not readily visible in the drilled samples. These results demonstrate that in some embodiments the manufactured holes enhance drying and at the same time may minimize or prevent thermal degradation of the lumber.

TABLE 5

Drying Rate of Alpine Fir Lumber with Varying Number of Holes Dried in a Microwave Oven (Two Layers)

| Number of Holes | Drying Time (minute) | | | | | | | | | | |
|---|---|---|---|---|---|---|---|---|---|---|---|
| & Position | 2 | 4 | 6 | 9 | 12 | 15 | 18 | 21 | 24 | 27 | 30 |
| Control (Bottom) | 0.58 | 0.57 | 0.66 | 0.79 | 0.93 | 1.12 | 1.27 | 1.42 | 1.54 | 1.62 | 1.73 |
| 4 (Bottom) | 0.62 | 0.66 | 0.87 | 1.05 | 1.25 | 1.38 | 1.54 | 1.64 | 1.74 | 1.83 | 1.90 |
| 3 (Top) | 0.49 | 0.54 | 0.67 | 0.78 | 0.95 | 1.10 | 1.23 | 1.36 | 1.46 | 1.51 | 1.58 |
| 2 (Top) | 0.49 | 0.46 | 0.57 | 0.64 | 0.77 | 0.91 | 1.07 | 1.16 | 1.22 | 1.27 | 1.31 |
| | 33 | 36 | 39 | 42 | 45 | 48 | 51 | 54 | 57 | 60 | |
| Control (Bottom) | 1.79 | 1.82 | 1.85 | 1.84 | 1.83 | 1.82 | 1.79 | 1.76 | 1.71 | 1.68 | |
| 4 (Bottom) | 1.94 | 2.01 | 2.02 | 2.04 | 2.02 | 1.98 | 1.93 | 1.88 | 1.83 | 1.78 | |
| 3 (Top) | 1.63 | 1.67 | 1.69 | 1.70 | 1.70 | 1.69 | 1.66 | 1.63 | 1.60 | 1.56 | |
| 2 (Top) | 1.33 | 1.35 | 1.36 | 1.35 | 1.34 | 1.32 | 1.31 | 1.29 | 1.26 | 1.23 | |

In alternative test, samples with 0, three, and four holes were prepared as in the first test of this example. The samples were laid in the microwave oven on the wide face of the lumber in one layer with no space between samples. The three-hole sample was located in the middle, and the control and the four-hole samples were located on each side of the middle sample. As in the first test, the weight was monitored every 3 minutes and the drying was continued until the control sample began to emit smoke.

The results for the alternative test are shown in Table 6. As in the first test, the drying rate was relatively rapid at the early stage of drying, ie. during the first 25 minutes, and then gradually decreased with further drying. The drilled samples showed a greater drying rate than the control up to a few minutes past the maximum drying rate observed for the former, ie. during the first 29 minutes. After this drying period, the control then showed a greater apparent drying rate (weight loss) than the four-hole sample. This was probably due to the onset of thermal degradation in the interior portion of the control, a process that was later manifested, at about 39 minutes into the drying period, by the emission of smoke from the control sample. At the end of the drying period, the control showed severe interior charring followed in decreasing order by the three-hole sample and the four-hole sample. The latter sample showed only slight charring. The three-hole sample exhibited a greater apparent drying rate than the four-hole sample, an effect which was probably due to the position of the sample in the oven, so that the three-hole sample may have absorbed more energy because it was located in the middle, between the other two samples, without any space between them. At about 25 minutes of drying, the four-hole sample showed about 8%, and the three-hole sample about 16%, greater drying than the control. These embodiments further demonstrate the effect manufactured holes may have on enhancing the drying rate of lumber, and a surprising controlling effect on the thermal degradation of the wood.

TABLE 6

Drying Rate of Alpine Fir Lumber with Varying Number of Holes Dried in a Microwave Oven (One Layer)

| Number of Holes & Position | Drying Time (minute) | | | | | | | |
|---|---|---|---|---|---|---|---|---|
| | 3 | 6 | 9 | 12 | 15 | 18 | 21 | 24 |
| Control (Side) | 0.48 | 0.69 | 1.00 | 1.36 | 1.64 | 1.86 | 2.03 | 2.09 |
| 3 (Middle) | 0.44 | 0.78 | 1.31 | 1.86 | 2.25 | 2.42 | 2.47 | 2.50 |
| 4 (Side) | 0.59 | 1.03 | 1.48 | 1.86 | 2.10 | 2.23 | 2.25 | 2.28 |
| | 27 | 30 | 33 | 36 | 39 | 42 | 45 | |
| Control (Side) | 2.14 | 2.20 | 2.19 | 2.12 | 2.05 | 1.97 | 1.93 | |
| 3 (Middle) | 2.47 | 2.42 | 2.34 | 2.25 | 2.15 | 2.04 | 1.96 | |
| 4 (Side) | 2.26 | 2.17 | 2.09 | 2.02 | 1.92 | 1.82 | 1.72 | |

Example 3

Effect of Thickness on Lumber Drying

In these embodiments, a comparison was made of the drying rate of green alpine fir lumber of different thicknesses using a controlled-temperature oven. Alpine fir lumber samples approximately 2 in.×6 in.×4 feet long were use in these embodiments. The samples included lumber that was full-thickness (unsplit), ½-thickness split and ⅓-thickness split. The samples were dried in an oven at 50° C. for 43 hours and at 85° C. for 24 hours. The weight and moisture content of the samples were monitored during the drying period. Moisture content was measured with a moisture meter. The results are shown in Tables 7 and 8 for the weight loss and moisture content, respectively. The percentage weight loss was relatively rapid during the first 37 hours of drying and also when the temperature was changed from 50° to 85° C., and then tended to level off with further drying. The ⅓-thickness split showed the most rapid weight loss followed, in decreasing order, by the ½-thickness split and the full-thickness samples. The ⅓-thickness split samples attained a moisture content of about 13% after only 16 hours of drying at 50° C. The same moisture content was attained by the ½-thickness split after 37 hours at the same temperature, while the full-thickness samples took about 65 hours (43 hours at 50° C. and 25 hours at 85° C.) to reach that same moisture content. Thus, the ½-thickness took more than twice as long, and the full-thickness more than four times as long, to dry to about 13% moisture content compared to the ⅓-split thickness samples. These data show the significant effect that the transverse thickness of the lumber may have on the rate of drying in some embodiments of the invention. In some applications of the methods of the invention.

TABLE 7

Percent Weight Loss of Alpine Fir Lumber of Different Thicknesses Dried In an Air-Circulation Oven

| Lumber Thickness (in.) | Drying Time (hr) | | | | | |
|---|---|---|---|---|---|---|
| | 15.5 | 20.0 | 37.3 | 42.7 | 60.3 | 67.4 |
| 1.70 | 3.91 | 4.72 | 7.57 | 9.99 | 14.79 | 16.36 |
| 0.85 | 10.88 | 12.27 | 15.92 | 20.78 | 23.05 | |
| 0.57 | 13.17 | 14.02 | 21.55 | 25.63 | 26.75 | |

TABLE 8

Weight Loss of Alpine Fir Lumber with Varying Number of Holes Dried in a Microwave Oven (One Layer)

| Number of Holes & Position | Drying Time (minute) | | | | | | | |
|---|---|---|---|---|---|---|---|---|
| | 3 | 6 | 9 | 12 | 15 | 18 | 21 | 24 |
| Control (Side) | 0.41 | 1.25 | 2.72 | 4.93 | 7.43 | 10.10 | 12.84 | 15.12 |
| 3 (Middle) | 0.40 | 1.42 | 3.59 | 6.77 | 10.23 | 13.24 | 15.77 | 18.19 |
| 4 (Side) | 0.56 | 1.94 | 4.20 | 7.03 | 9.97 | 12.68 | 14.89 | 17.25 |
| | 27 | 30 | 33 | 36 | 39 | 42 | 45 | |
| Control (Side) | 17.42 | 19.93 | 21.81 | 23.06 | 24.12 | 24.95 | 26.16 | |
| 3 (Middle) | 20.25 | 22.05 | 23.47 | 24.63 | 25.50 | 26.07 | 26.74 | |
| 4 (Side) | 19.23 | 20.60 | 21.81 | 22.92 | 23.70 | 24.13 | 24.44 | |

Example 4

Effect of Drilled Holes on Water Absorption of Wood

In this example, a comparison was made of the water absorption of alpine fir lumber with varying hole sizes and varying number of holes. In the first test, the hole size was varied with the holes drilled through the wide face of the lumber. The samples used were dried lumber pieces of approximately 2 in.×4 in.×3 feet. The hole sizes were 0, ⅜, ¾, and 1 inch in diameter. Five holes were drilled in each piece, two about 3 inches from each end and three in the middle section spaced 7 inches apart center-to-center. The samples were submerged lying flat horizontally in water at room temperature. After a 2-hour submersion, the samples were removed from the water and the excess surface water was removed, after which the samples were immediately weighed. This weighing procedure was repeated for an additional submersion of 4 and 22 hours.

The results are shown in Table 9. The water absorption increased with increasing hole size and soaking time. The rate of absorption was faster during the first two hours and relatively slower with further soaking up to 24 hours. After 24 hours of soaking, the ⅜-inch-hole, ¾-inch-hole, and 1-inch-hole samples showed respectively 1.5%, 12%, and 21% greater absorption than the control. These results demonstrate the effect manufactured holes may have in enhancing liquid absorption by lumber. In some embodiments of the invention, liquids such as preservatives may be infused into the lumber through the manufactured holes before or after the lumber is dried.

TABLE 9

Percent Water Absorption of Drilled Alpine Fir Lumber with Varying Hole Size

| Hole Diameter | Soak Time (hr) | | |
|---|---|---|---|
| (in.) | 2 | 6 | 24 |
| Control | 3.73 | 5.56 | 9.48 |
| ⅜ | 3.86 | 5.75 | 9.62 |
| ¾ | 4.44 | 6.65 | 10.77 |
| 1 | 5.17 | 7.38 | 12.05 |

In alternative test embodiments, the number of holes was varied, with samples having 0, 3, 4 and 7 holes, while the hole size remained fixed at 1 inch. The lumber used in these tests was dried and approximately 2 in.×4 in.×8 feet in nominal size. For the three-hole sample the holes were spaced about 2 feet apart and 2 feet from each end, for the four-hole sample the holes were spaced 1.5 feet apart and 1.75 feet from each end, and for the seven-hole sample the holes were placed about 1 foot apart and about 1 foot from each end, center-to-center.

The results of these tests summarized in Table 10. The water absorption by these samples increased with increasing number of holes and soaking time. As in the first test in this example, the rate of absorption was faster during the first two hours and decreased with further soaking. After 24 hours of soaking, the three-, four-, and seven-hole samples showed respectively 15%, 16%, and 25% greater liquid absorption than the control. These results further demonstrate the enhancement effect of manufactured holes on liquid absorption in some embodiments of the invention.

TABLE 10

Percent Water Absorption of Drilled Alpine Fir Lumber with Varying Number of Holes

| | Soak Time (hr) | | |
|---|---|---|---|
| Number of Holes | 2 | 6 | 24 |
| Control | 3.89 | 5.33 | 8.55 |
| 3 | 4.52 | 6.33 | 9.97 |
| 4 | 4.78 | 6.30 | 10.11 |
| 7 | 5.31 | 7.16 | 11.43 |

Example 5

Effect of Drilled Holes on Lumber Drying Using Superheated Steam/Vacuum Method In this example, a comparison was made of the drying of drilled and undrilled lumber using a laboratory superheated steam/vacuum (SS/V) kiln. The samples were green spruce lumber approximately 4¼ in.×4¼ in.×8 feet. In the first test, samples with 0, two, three, four, and seven holes, 1 inch in diameter, were prepared. The holes were drilled through two faces of the lumber. For the two-hole sample, the holes were spaced 3 feet apart and 2.5 feet from each end, for the three-hole sample the holes were placed 2 feet apart and 2 feet from each end, for the four-hole sample the holes were placed 1.5 feet apart and 1.75 feet from each end, and for the seven-hole sample the holes were placed 1 foot apart and 1 foot from each end, center-to-center. The samples were combined in two packages, each 6 samples wide×3 samples high. Four spacers, ¾-inch thick×1½-inch wide, were placed between layers of the packages, one at each end and two equally spaced at the middle portion.

The results are summarized in Tables 11 and 12. The results showed that 92% of the drilled samples and only 33% of the control samples were acceptable based on a selected maximum average moisture content of 18%, where the average is taken from the outer, intermediate and core layers and the moisture content is determined by the ovendry method (Table 11). Based on the average moisture content of only the two outer layers, ie. the first 0.8 in. strips from the surface, 100% of the drilled samples and only 83% of the control samples were acceptable. The number of acceptable pieces decreased as the moisture content basis used was changed from that of the surface to that of the core layer. For example, when the core layer moisture content was used as the basis, 75% of the drilled samples and only 25% of the control samples were acceptable. The average moisture contents of the drilled samples for the three layers were all below 18%, with an overall average (average of all the drilled samples) of about 13.7%, while that of the control samples was 23.3% (Table 12). The average moisture content distributions in the transverse (thickness) direction for the different treatments are shown in Table 13. The drilled samples exhibited a more uniform moisture content distribution within each sample, compared to the control. This provides an indication that in some embodiments of the invention drilled lumber would be more stable than undrilled lumber in its warping behaviour. These results demonstrate the effectiveness of manufactured holes may have in some embodiments in enhancing the drying of lumber and potentially improving the dimensional stability of thick lumber.

TABLE 11

Percentage of Acceptable * Pieces of the Superheated Steam Vacuum Dried 4 × 4 Spruce Lumber with Full Manufactured Holes

| Moisture Content Basis | Control | Drilled (2–7 Full Holes) |
|---|---|---|
| Outer Layer (First 0.8" Strips from Surface) | 83 | 100 |
| Intermediate Layer (Second 0.8" Strips from Surface) | 28 | 83 |
| Core (Middle 0.8" Strip) | 25 | 75 |
| Overall Average | 33 | 92 |

* Based on a maximum moisture content of 18%.

TABLE 12

Moisture Content (MC) of the Superheated Steam Vacuum Dried 4 × 4 Spruce Lumber with Full Manufactured Holes

| No. of Full Holes | Average MC (%) | MC (%) Range |
|---|---|---|
| 0 | 23.3 | 12.1–41.4 |
| 2 | 13.7 | 12.9–14.7 |
| 3 | 17.3 | 12.5–26.3 |
| 4 | 10.5 | 9.3–12.3 |
| 7 | 13.1 | 11.1–16.3 |

TABLE 13

Moisture Content Distribution in the Thickness Direction of the Superheated Steam Vacuum Dried 4 × 4 Spruce Lumber with Full Manufactured Holes

| Layer | Moisture Content (%) | |
|---|---|---|
| | 7 Holes | Control |
| Outer[1] | 13.3 | 14.5 |
| Intermediate[2] | 14.5 | 33.6 |
| Core[3] | 16.1 | 42.0 |
| | 4 Holes | Control |
| Outer | 10.3 | 13.9 |
| Intermediate | 11.0 | 16.8 |
| Core | 10.2 | 21.4 |
| | 3 Holes | Control |
| Outer | 12.3 | 15.9 |
| Intermediate | 17.9 | 31.6 |
| Core | 26.2 | 39.5 |
| | 2 Holes | Control |
| Outer | 12.4 | 16.3 |
| Intermediate | 14.5 | 25.4 |
| Core | 16.1 | 28.4 |

[1]First 0.8 inch strip from surface
[2]Second 0.8 inch strip from surface
[3]Middle 0.8 inch strip A second test was conducted as part of this example, in which samples with half-through holes were included. The results of these tests are shown in Tables 14 and 15. The results showed that 100% of the drilled samples with full holes, 93% of the samples with half holes and only 65% of the control samples were acceptable based on a selected maximum average moisture content of 18%, ie. the average of the three layers (Table 14). Based on the average moisture content of the outer layers, 100% of the drilled samples with half or full holes were acceptable compared to only 94% for the control. As found in the first test of this example, the number of acceptable pieces decreased as the moisture content basis was changed from that of the surface to that of the core layer. When based on the core layer moisture content, 100% of the drilled samples with full holes and 71% of those with half holes were acceptable compared to only 47% for the control. The same trend was observed when the comparison was based on the intermediate layer moisture content. The overall average moisture content of the control samples was 17.8% with a range of 12.5 to 15.9% (Table 15). In contrast, the overall average moisture content of the drilled samples was lower, being 13.0% and 14.6% for those with full and half holes, respectively. The overall moisture content range for the samples with half holes was 12.0 to 23.8%, and for the samples with full holes was 11.5 to 15.2%.

The moisture content distributions in the thickness (transverse) direction for the different treatments is summarized in Table 16. The drilled samples exhibited a more uniform moisture content distribution compared to the control, and so did those with full holes compared to those with half holes. Thus, in some embodiments, the full holes may provide more efficient drying than the half holes. These results further demonstrate the effectiveness manufactured holes may have in enhancing the drying of thick lumber in some embodiments.

TABLE 14

Percentage of Acceptable * Pieces of the Superheated Steam Vacuum Dried 4 × 4 Spruce Lumber with Full and Half Manufactured Holes

| Moisture Content Basis | Control | Drilled (2–7 Full and Half Holes) | |
|---|---|---|---|
| | | Half Holes | Full Holes |
| Outer Layer (First 0.8" Strips from Surface) | 94 | 100 | 100 |
| Intermediate Layer (Second 0.8" Strips from Surface) | 65 | 93 | 100 |
| Core Layer (Middle 0.8" Strip) | 47 | 71 | 100 |
| Overall Average | 65 | 93 | 100 |

* Based on a maximum moisture content of 18%.

TABLE 15

Moisture Content (MC) of the Superheated Steam Vacuum Dried 4 × 4 Spruce Lumber with Full and Half Manufactured Holes

| No. of Hole | Hole Type | Average MC (%) | MC (%) Range |
|---|---|---|---|
| 0 | N/A | 17.8 | 12.5–33.9 |
| 2 | Full | 15.2 | — |
| 3 | Full | 13.2 | — |
| 4 | Full | 11.5 | — |
| 7 | Half | 12.0 | — |
| 2 | Half | 14.0 | 12.7–15.2 |
| 3 | Half | 14.5 | 12.0–16.6 |
| 4 | Half | 15.6 | 12.4–23.8 |
| 7 | Half | 14.4 | 12.6–16.1 |

Example 6

Effect of Drilled Holes on Lumber Drying Using Radio Frequency/Vacuum Method (commercial scale)

Test embodiments similar to those disclosed in Example 5 were prepared, in which the drying facility used was a commercial radio frequency/vacuum kiln. The samples used were 4¼ in.×4¼ in.×8 feet green spruce-pine lumber. Full and half hole samples were prepared with 0, three, four, and seven holes. The samples were piled together in the kiln without spacers.

The results are presented in Table 17. Based on a selected maximum overall average moisture content of 15%, 100% of the drilled samples with full holes and 75% of those with half holes were acceptable, while only 56% of the control samples were acceptable. At the same moisture content limit, similar values were obtained when the comparison was based on the average moisture content of the outer layers. The number of acceptable pieces was lower when the comparison was based on the moisture content of the intermediate or core layers. For both of these layers at the same moisture content limit, 86% of the drilled samples with full holes and 50% of those with half holes were acceptable, compared to only 33% acceptable samples for the control. When the moisture content basis was increased to 18%, 100% of the drilled samples with half or full holes were acceptable compared to only 89% for the control when the comparison was made on the intermediate layer, core layer or overall average moisture content. At the same moisture content limit, the control samples also yielded 100% acceptable pieces when based on the outer layer. As in example 5, the full holes provided more efficient drying than the half holes. These results further demonstrate the effectiveness of manufactured holes in some embodiments in enhancing the drying of thick lumber.

TABLE 16

Moisture Content Distribution in the Thickness Direction of the Superheated Steam Vacuum Dried 4 × 4 Spruce Lumber with Full and Half Manufactured Holes

| Layer | Moisture Content (%) | |
|---|---|---|
| | 7 Half Holes | Control |
| Outer[1] | 12.3 | 13.4 |
| Intermediate[2] | 15.4 | 20.6 |
| Core[3] | 16.4 | 25.6 |
| | 4 Half Holes | Control |
| Outer | 12.1 | 13.1 |
| Intermediate | 16.9 | 20.2 |
| Core | 19.8 | 23.5 |
| | 3 Half Holes | Control |
| Outer | 12.8 | 13.9 |
| Intermediate | 15.4 | 21.3 |
| Core | 16.2 | 26.9 |
| | 2 Half Holes | Control |
| Outer | 12.2 | 13.9 |
| Intermediate | 14.8 | 20.8 |
| Core | 15.8 | 24.6 |
| | 7 Full Holes | Control |
| Outer | 10.5 | 12.6 |
| Intermediate | 12.6 | 17.2 |
| Core | 13.5 | 19.6 |
| | 4 Full Holes | Control |
| Outer | 10.4 | 11.7 |
| Intermediate | 12.1 | 14.4 |
| Core | 12.6 | 18.6 |
| | 3 Full Holes | Control |
| Outer | 12.3 | 14.0 |
| Intermediate | 13.7 | 19.2 |
| Core | 14.2 | 23.8 |
| | 2 Full Holes | Control |
| Outer | 13.1 | 13.9 |
| Intermediate | 16.0 | 20.8 |
| Core | 17.6 | 24.6 |

[1]First 0.8 inch strip from surface
[2]Second 0.8 inch strip from surface
[3]Middle 0.8 inch strip

TABLE 17

Percentage of Acceptable Pieces of the RF/V Dried 4 × 4 Spruce-Pine Lumber with Full and Half Manufactured Holes

| Moisture Content | Control | | (3–7 Drilled Full and Half Holes) | | | |
|---|---|---|---|---|---|---|
| Basis | 15% MC | 18% MC | 15% MC | | 18% MC | |
| | | | Half | Full | Half | Full |
| Outer Layer (First 0.8" Strips from Surface) | 56 | 100 | 75 | 100 | 100 | 100 |
| Intermediate Layer (Second 0.8" Strips from Surface) | 33 | 89 | 50 | 86 | 100 | 100 |
| Core Layer (Middle 0.8" Strip) | 33 | 89 | 50 | 86 | 100 | 100 |

Example 7

Strength Properties of Various Types of Dowels Used in an Engineered Wood Composite Product Tests were carried out to determine the flexural properties, such as modulus of rupture (MOR) and modulus of elasticity (MOE), of various types of dowels used to join pieces of lumber to form a composite wood product of the invention. The composite wood product was prepared using dowelling to join lumber pieces, where the lumber pieces were provided with corresponding holes for receiving the dowelling. The dowels were aluminum (⅜ inch diameter), wood (⅜, 5/16, ¼ inch diameter), and plastic (⅜ inch diameter). Testing was carried out in an Instron machine. The specimens were centrally loaded on span lengths of 152.4 mm, 127.0 mm, and 101.6 mm for the ⅜-, 5/16-, and ¼-inch dowels, respectively. The load was applied continuously at a rate of motion of the movable crosshead of 4.1, 3.4, and 2.7 mm/min for the ⅜-, 5/16-, and ¼-inch dowels, respectively.

The results are shown in Table 18. The aluminum dowel showed the highest MOR and MOE values of 80,274 psi and 8,672,425 psi, respectively, followed in decreasing order by the wood dowel, 25,430 to 30,179 psi and 2,380,175 to 2,694,045 psi, and the plastic dowel, 16,656 psi and 510,465 psi. Thus, the aluminum dowel was about 65% and 79% stronger than the wood and plastic dowels, and 71% and 94% stiffer than the wood and plastic dowels, respectively.

TABLE 18

Strength Properties of Various Types of Dowels

| Dowel Type | Diameter (inch) | Modulus of Rupture (psi) | Modulus of Elasticity (psi) |
|---|---|---|---|
| Aluminum | ⅜ | 80,274 | 8,672,425 |
| Wood | ⅜ | 28,304 | 2,565,160 |
| | 5/16 | 25,430 | 2,380,175 |
| | ¼ | 30,179 | 2,694,045 |
| Plastic | ⅜ | 16,656 | 510,465 |

Example 8

Effect of Manufactured Holes on Strength Properties of Lumber

In the first set of tests in this example, the effect of hole diameter and hole type (glued dowel and unglued dowel) on the strength properties (MOR and MOE) of the lumber was examined. The hole diameters tested were ½ and 1 inch, drilled in the center and through the full thickness of the lumber. The material used was 2×4-inch nominal dried alpine fir lumber, and the dowel used was wood. The glued dowel was bonded with catalyzed polyvinyl acetate (PVA) adhesive. The samples were tested in flat bending in an Instron machine. The samples were centrally loaded on the surface nearest the pith on a span of 21 inches in such a way that the manufactured hole was located in the center. The load was applied continuously at a rate of motion of the movable crosshead of 0.10 in. (2.5 mm)/min.

The results are shown in Table 19. For the samples with the ½-inch hole diameter, there were no statistically significant differences in MOR values among the unglued dowel, glued dowel, and control (no hole), although the latter showed the highest average MOR followed, in decreasing order, by the glued dowel and unglued dowel. However, the control gave significantly higher MOE than the unglued dowel, but no significant difference in MOE was observed between the glued dowel and control. The control yielded about 8.6% greater MOE than the unglued dowel. For the samples with the 1-inch hole diameter, there were no significant differences in strength properties between the unglued and glued dowels, although the latter showed higher average strength values compared to the former. However, the control showed significantly higher strength properties than the unglued and glued dowels. The control gave about 25.2% and 17.1% greater MOR and MOE, respectively, than the unglued dowel, and 17.4% and 12.5% greater MOR and MOE, respectively, than the glued dowel. These results showed that in some embodiments gluing the dowel may improve the strength properties of wood products manufactured in accordance with the invention, particularly the MOE of embodiments with smaller holes.

TABLE 19

Flexural Properties of Alpine Fir Lumber with Manufactured Holes
Hole Drilled Through Full Thickness (Glued Dowel Bonded with PVA)
Tested in Flat Bending

| Hole Type | Hole Diameter (inch) | MOR (psi) | MOE (psi) |
|---|---|---|---|
| Unglued Dowel | ½ | 5,137 | 894,800 |
| Glued Dowel | ½ | 5,266 | 918,855 |
| Unglued Dowel | 1 | 4,262 | 812,192 |
| Glued Dowel | 1 | 4,703 | 857,143 |
| Control | N.A. | 5,695 | 979,438 |

In alternative tests, the effect on strength of hole depth and hole diameter was examined. The hole depths tested were 0 (control), half, and full thickness, and the hole diameters tested were ½, ¾, and 1 inch drilled on the face (wider transverse dimension) of the lumber. Three samples (control, half, and full thickness) for each hole-diameter class were taken from the same board. The dowels were bonded with phenol-resorcinol formaldehyde (PRF) adhesive. The procedure for testing of the samples was the same as that described above in previous examples.

The results are shown in Table 20. For the samples with the ½-inch hole diameter, there were no significant differences in the strength properties of the samples with varying depths of hole, although the control showed the highest average strength values followed, in decreasing order, by the half hole and full hole. The results for the ¾-hole diameter were similar to those of the ½-hole diameter, ie. there were no significant differences in the strength properties of the samples with varying hole depths, although the latter also gave the highest average strength values compared to the drilled samples. For the samples with the 1-inch hole diameter, the analysis indicated that for these embodiments there were significant differences in the strength properties of the samples with varying hole depths. For MOR, the significant differences were observed between the full hole and control and between the half hole and control, but there was no significant difference between the full hole and half hole although the latter yielded a higher average MOR value than the full hole. The control showed about 30.9% and 21.4% greater MOR than the full hole and half hole, respectively. For MOE, the only significant difference observed was between the full hole and control. No significant differences existed between the full hole and half hole and between the half hole and control, although the half hole gave a higher average MOE than the full hole and that the control yielded a higher average MOE than the half hole. The control showed about 14.8% greater MOE than the full hole. These data indicate that in some embodiments manufactured holes which are plugged with glued wood dowel may not significantly affect the strength properties (MOR and MOE) of the lumber in bending. In addition, manufactured holes up to 1 inch in diameter, drilled only up to half the thickness of the lumber and plugged with a glued wood dowel, may be adapted so as not to significantly affect the stiffness (MOE) of the lumber in bending, although the strength (MOR) may be reduced.

TABLE 20

Flexural Properties of Alpine Fir Lumber with Manufactured Holes
Hole Drilled on Face (Dowel Glued with PRF)
Tested in Flat Bending

| Depth of Hole | Hole Diameter (inch) | MOR (psi) | MOE (psi) |
|---|---|---|---|
| Full | ½ | 4602 | 875,550 |
| Half | ½ | 5086 | 891,678 |
| Control | N.A. | 5391 | 908,520 |
| Full | ¾ | 4394 | 862,050 |
| Half | ¾ | 4694 | 872,420 |
| Control | N.A. | 5147 | 891,400 |
| Full | 1 | 4169 | 830,850 |
| Half | 1 | 4740 | 898,080 |
| Control | N.A. | 6034 | 975,470 |

Example 9

Dimensional Stability of a New Engineered Wood Composite Product

Tests were conducted to compare the warping properties of the engineered wood composite product of the invention made by edge gluing lumber pieces joined with various types of dowels. Panel samples, 18 inches wide (in the transverse direction, across the grain)×48 inches long (in the longitudinal direction, along the grain), were prepared from 2×4-inch green alpine fir lumber glued with PRF adhesive. The panels were constructed from five lumber pieces in such a way that the adjacent pieces had the same grain orientation. Three types of dowels were used, namely aluminum, wood, and plastic, all with ⅜-inch diameter. Four dowels were inserted across the width, two 3 inches from each end and two in the middle section spaced 14 inches apart center-to-center. The dowels were inserted through holes drilled on the narrow face of the lumber just before pressing the pieces together to form the composite panel. Similar panels were prepared without dowels to serve as controls.

The warping (bow, cup, and twist) of the panels was measured about three to four weeks after they were made, at which time the average moisture content was then about 13% as measured by a moisture meter. The results are shown in Table 21. The warping values of the dowel-reinforced panels were lower than those of the controls. These results demonstrate the positive effect of the dowels in improving the dimensional stability of the composite panels of the invention.

TABLE 21

Dimensional Stability of a New Engineered Wood Composite Product

| Dowel | Initial MC (%) | MC (%) at Test | Bow (mm) | Cup (mm) | Twist (mm) |
|---|---|---|---|---|---|
| Aluminum | >20 | 13.1 | 0.8 | 4.7 | 0 |
| Wood | 25.1 | 11.7 | 0 | 3.3 | 0 |
| Plastic | 21.4 | 13.2 | 1.3 | 5.0 | 1.3 |
| Control | 29.2 | 12.6 | 2.2 | 5.4 | 10.5 |

Example 10

Strength Properties of the Engineered Wood Composite Product

Panel samples similar to those disclosed in Example 9, but with the adjacent pieces arranged in alternating grain orientation, were made to compare the effects of dowel type on the strength properties of the panels. The adhesives used were PRF and catalyzed PVA.

Strips, 2 inches wide, were cut across the width of the panels. The strips included samples with and without dowels for comparison. The samples were tested in bending to compare the MOR, MOE, and energy absorption perpendicular to the grain, in which the test span is perpendicular to the grain (longitudinal) direction of the wood. Testing was carried out in an Instron machine. The specimen was centrally loaded on a span length of 15.5 inches (393.7 mm). The load was applied continuously at a rate of motion of the movable crosshead of 2.5 mm (0.10 in.)/min. The test was continued to about a 2-inch (50-mm) deflection, or until the specimen failed to support a load of about 35 lb.

Figure 2:
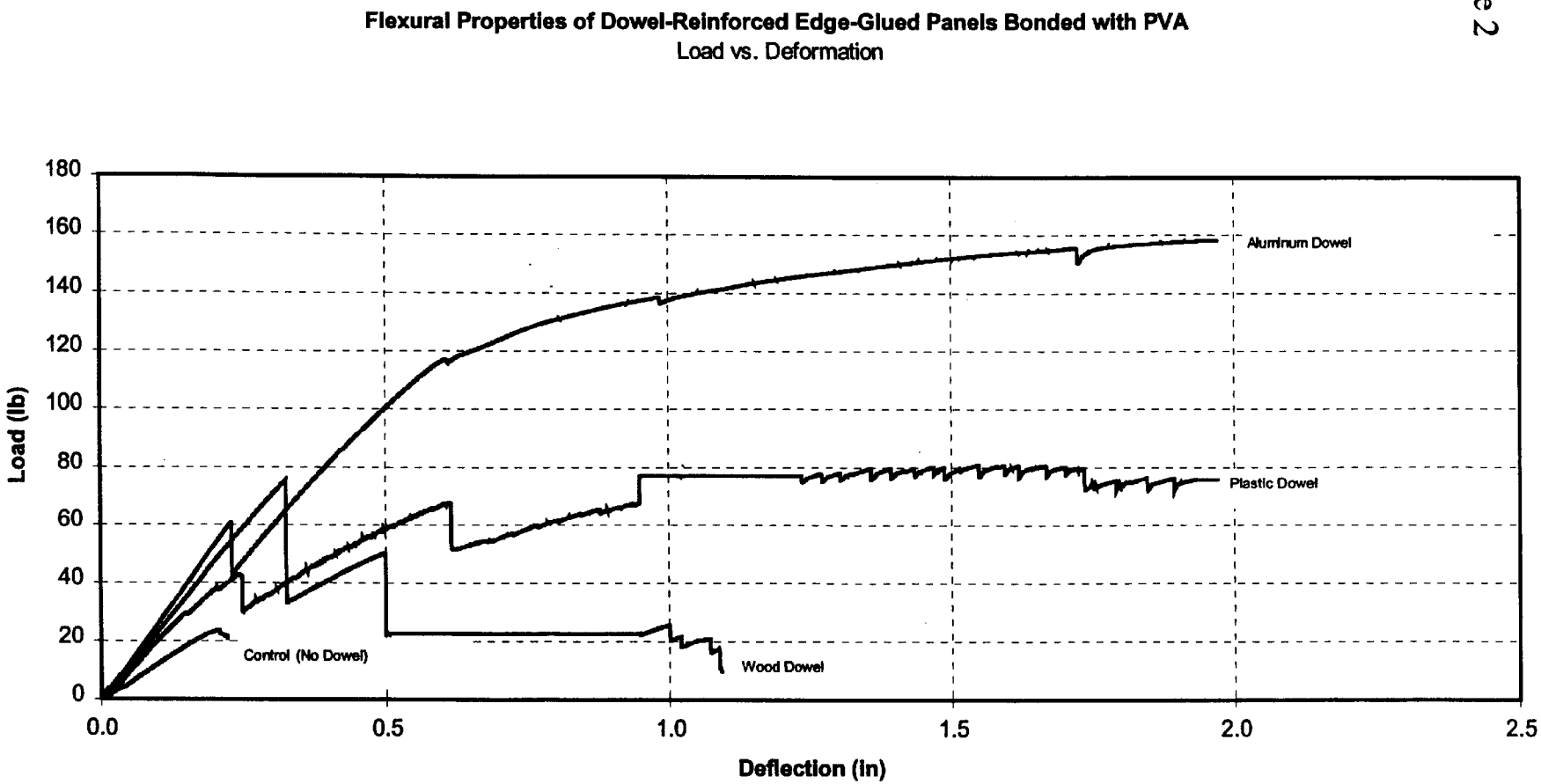
FIG. 2 is a graph showing flexural properties of dowel-reinforced edge-glued panels bonded with PVA, showing load vs. deformation.

The results are shown in Table 22. The reinforced samples exhibited greater MOR, MOE, and energy absorption than the control. For PRF, the reinforced samples yielded 2.6 to 4.4 times greater MOR, 1.4 to 1.6 times greater MOE, and 9 to 31 times greater energy absorption, than the control. Similarly for PVA, the reinforced samples gave 1.4 to 2.8 times greater MOR, 1.1 to 1.7 times greater MOE, and 2.6 to 19 times greater energy absorption, than the control. The aluminum showed the highest MOR, MOE, and energy absorption compared to the wood and plastic dowels. The most significant difference was observed in the energy absorption for which the aluminum yielded more than 3 times greater than that of the wood dowel in the case of the PRF, and more than 7 times greater in the case of the PVA glued samples. It exhibited as much as 31 times and 19 times greater energy absorption than the control for the PRF and PVA glued samples, respectively. Comparisons of the load-deformation curves for the samples reinforced with the different types of dowels are shown graphically in FIGS. 1 and 2 for the PRF and PVA glued samples, respectively. The aluminum consistently showed the highest load capacity compared to the other two dowels, and the control showed the lowest value. These results are consistent with those of Example 7 in which the aluminum dowel exhibited the greatest bending strength compared to the wood and plastic dowers.

TABLE 22

Strength Properties and Energy Absorption of a New Engineered Composite Wood Product Perpendicular to the Grain

| Dowel | MOE (psi) | MOE Ratio (Dowel/Control) | MOR (psi) | MOR Ratio (Dowel/Control) | Energy Absorption (in - lb) | Energy Absorption Ratio (Dowel/Control) |
|---|---|---|---|---|---|---|
| | | PRF Adhesive | | | | |
| Aluminum | 32,216 | 1.60 | 729 | 4.39 | 220.4 | 31.0 |
| Wood | 28,722 | 1.43 | 433 | 2.61 | 64.3 | 9.1 |
| Plastic | | | | | | |
| Control (No dowel) | 20,088 | | 166 | | 7.1 | |
| | | PVA Adhesive | | | | |
| Aluminum | 39,163 | 1.65 | 818 | 2.75 | 234.2 | 18.9 |
| Wood | 37,671 | 1.59 | 405 | 1.36 | 32.8 | 2.6 |
| Plastic | 25,568 | 1.08 | 423 | 1.42 | 123.3 | 9.9 |
| Control (No dowel) | 23,753 | | 297 | | 12.4 | |

Example 11

Shear Properties of the Engineered Wood Composite Product.

Block shear samples, 2 inches along×1½ inches across the grain (in the transverse direction) with the glueline in the middle of the latter direction, were prepared from the panels described in Example 10. Samples were tested with and without dowels for comparison. Samples were tested in shear (horizontal and rolling) to compare shear strength and energy absorption. Testing was carried out in an Instron machine. The load was applied continuously at a rate of motion of the movable crosshead of 0.024 in. (0.6 mm)/min. The test was continued to about a 0.75-inch (19-mm) displacement, or until the specimen failed to support a load of about 35 lb.

The results are shown in Table 23. The horizontal shear was greater than the rolling shear strength. For PRF, the reinforced samples showed horizontal-to-rolling shear ratios of about 1.9 to 2.6, and that of the control was higher, ie. 3.6. Similarly for PVA, the reinforced samples gave ratios of about 2.0 to 3.7, and the control 4.7. The lower ratios for the reinforced samples indicate that they were more uniform in shear properties in both directions than the control. The reinforced samples generally showed slightly lower horizontal shear strength, but greater rolling shear strength and energy absorption than the control. In some embodiments, rolling shear strength and energy absorption may be considered to be more important properties than horizontal shear strength. For PRF, the reinforced samples yielded about 1.4 to 1.8, and for PVA 1.3 to 1.8, greater rolling shear strength than the control. The aluminum showed the greatest rolling shear strength compared to the wood and plastic dowels. The most significant difference observed between the reinforced samples and the control was in terms of the energy absorption developed. For PRF, the reinforced samples yielded about 3 to 6 times, and for PVA 2 to 9 times, greater energy capacity than the control. These results provide further evidence of the ability of the reinforced composite panels to sustain applied stress, in this case shear stress, for a long period of time.

TABLE 23

Shear Strength Properties and Energy Absorption of a New Engineered Wood Composite Product

| Dowel | Block Shear | Shear Strength (psi) | | | | | | Energy Absorption (in - lb) | | | |
|---|---|---|---|---|---|---|---|---|---|---|---|
| Type | Type | PRF | H/R | PRF/C | PVA | H/R | PVA/C | PRF | PRF/C | PVA | PVA/C |
| Aluminum | Horizontal (H) | 1247 | 1.94 | 0.96 | 1192 | 2.04 | 0.78 | 543.43 | 4.77 | 619.45 | 4.39 |
| | Rolling (R) | 642 | | 1.79 | 585 | | 1.79 | 463.10 | 4.66 | 657.62 | 8.69 |
| Plastic | Horizontal | 1236 | 2.56 | 0.95 | 1448 | 2.80 | 0.94 | 449.46 | 3.94 | 637.60 | 4.52 |
| | Rolling | 483 | | 1.35 | 518 | | 1.59 | 304.99 | 3.07 | 390.18 | 5.15 |
| Wood | Horizontal | 1191 | 2.16 | 0.92 | 1588 | 3.72 | 1.04 | 586.55 | 5.14 | 276.88 | 1.96 |
| | Rolling | 552 | | 1.54 | 427 | | 1.31 | 613.89 | 6.18 | 236.76 | 3.15 |
| Control (C) | Horizontal | 1297 | 3.61 | | 1533 | 4.70 | | 114.02 | | 141.04 | |
| (No Dowel) | Rolling | 359 | | | 326 | | | 99.31 | | 75.70 | |

Example 12

Strength Properties of the Engineered Wood Composite Product Using Large Test Samples Board samples, 9.25 inches wide (across the grain)×12 feet long (along the grain), were prepared by edge gluing nominal 2×4-inch dried alpine fir lumber. The boards were constructed from three lumber pieces in such a way that the adjacent pieces had alternating grain orientation. The bonding agent used was PRF adhesive. Aluminum dowel, ⅜-inch in diameter, was used as the reinforcement. The dowels were inserted across the width, two 3 inches from each end and 11 in the middle section spaced approximately 1 foot apart. The dowels were inserted through holes drilled on the narrow face of the lumber before pressing the board. A similar board was prepared without dowels to serve as control. The boards were tested in bending to compare the MOE, MOR, and energy absorption parallel to the grain, ie. the test span was parallel to the grain direction of the wood. The flatwise MOE was determined on the whole board using a span-to-depth ratio of 90:1 (span of 135 inches) in accordance with the ASTM 4761 standard. A pre-load of 5 lb was used. Deflection measurements were taken at three increments of approximately 10 lb each. After the MOE was determined, the board was cut into four specimens, about 4 feet long along the grain, for the determination of MOR. The MOR specimens were tested at third-point loading also in accordance with the ASTM 4761 standard using a span-to-depth ratio of 21:1 (span of 31.5 inches). The loading configuration at each of the third points were two concentrated loads spaced 6.75 inches apart and centered across the width of the specimen. The load was applied continuously at a rate of motion of the movable crosshead of 0.20 in./min. The test was continued until the specimen failed to support 60% of the maximum load attained.

The results are shown in Table 24. The reinforced sample exhibited greater strength properties, ie. about 6.4% greater MOE, 16.5% greater MOR, and 26.4% greater energy absorption, than the control. These results further demonstrate the positive attribute of the reinforced panel in sustaining greater applied flexural load.

TABLE 24

Strength Properties and Energy Absorption Parallel to the Grain of the New Engineered Composite Wood Product Reinforced with Aluminum Dowel

| Treatment | MOE ($10^5$ psi) | MOR (psi) | Energy Absorption (in-lb) |
|---|---|---|---|
| Reinforced | 1.41 | 8085 | 3070 |
| Control (No Dowel) | 1.32 | 6755 | 2259 |

Example 13

Manufactured Clear, Dry Lumber

This example discloses a method for treating a piece of lumber to detect defects, such as knots, with electro-optic scanning, and then replacing the defects with plugs, which may be made of clear wood. The plugs, which may be either the full or partial thickness of the lumber, may be bonded to the lumber with an adhesive.

Figure 3:
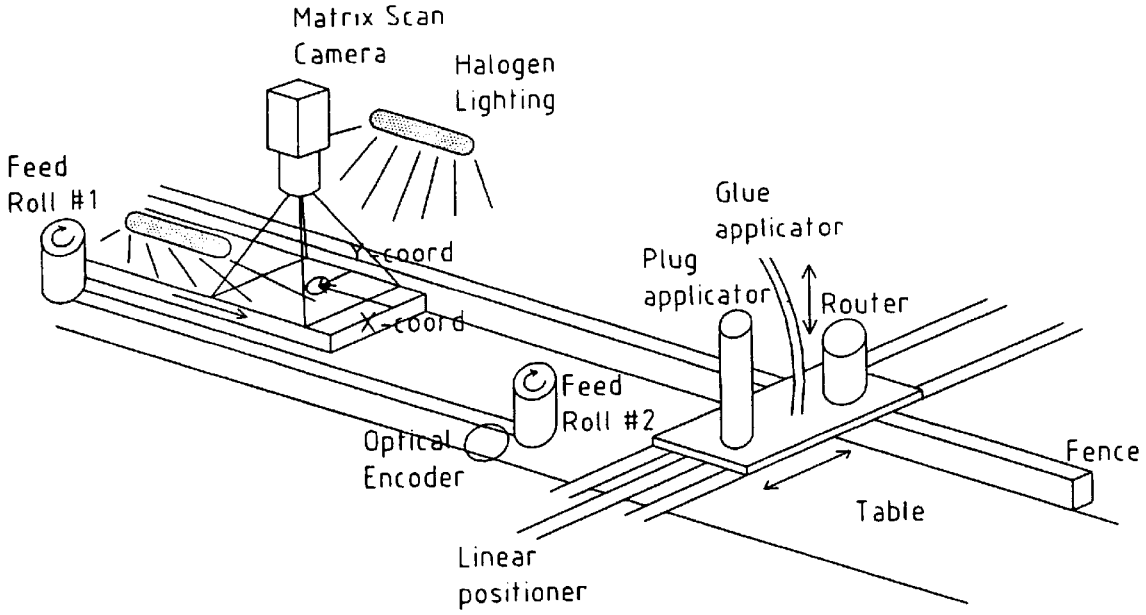
FIG. 3 is a schematic representation of an automated scanning and boring system.

As is partially shown schematically in FIG. 3, the exemplified system is comprised of an electro-optic scanning sub-system that scans, analyses the resulting image, detects defects and then communicates co-ordinates of the defects and related information to a machining unit sub-system. A machining unit sub-system performs boring operations, and may also perform gluing and plugging operations in alternative embodiments. The entire process may be automated using general purpose computers and software in conjunction with industrial automation devices.

The scanning subsystem may be comprised of a lumber feeding system, electro-optical scanners, a computer with data acquisition hardware and the requisite software. In such a system, lumber is fed through the fields-of-view of the scanner by a motorized conveyor system. The lumber images collected by the scanners are digitally processed and compared for parameters characteristic of defects fit for replacement, such as an empirically determined colour difference threshold. Once the defect is identified, the size, shape, and location of the defect may be identified and this information may be stored for subsequent processing at the machining sub-system.

The software used in the scanning sub-system may be an integrated program responsible for controlling the acquisition of images, processing the digital data, defect detection by characterization of the defect properties and communication of this information. Such software may for example be written in the C++ programing language. The user interface, skeleton of the program, defect detection algorithms and other components may be tailored using some functions available as components of software libraries available with data acquisition hardware. For example, the XVL or Extended Vision Library available with frame grabbers from Dipix Technologies Inc. may be used.

Data for each piece of lumber, such as the co-ordinates of the defects, may be communicated by the scanning subsystem to the boring and plugging subsystem via an electronic network. This data may then be processed by a general purpose computer, programmed to control the feed system and positioning of the boring assembly. Such software may for example be written in the graphical programming language, Labview, available from National Instruments Corp. The user interface and skeleton (sequencing and timing structure) of the program may be adapted for various embodiments of the invention.

The boring bit may be plunged either completely through the lumber or to a predetermined depth. The sequence may be repeated for each defect identified for removal. Up to four sides of the lumber may be subjected to processing, either individually or sequentially.

Example 14

Dimensional Stability in Manufactured Clear, Dry Lumber

Wood expands and contracts as its moisture content changes. This dimensional instability can over time damage wood, particularly if parts of a piece of lumber, or parts of a wooden assembly expand and contract at different rates.

This example involves the examination of the dimensional stability of lumber having knots replaced with plugs in accordance with the present invention, compared to lumber having knots. Five 2"×4"×8" lodgepole pine samples each containing three replacement plugs were prepared. These samples were measured for original weights and dimensions. The initial moisture contents were determined using the oven dry method.

The samples were then soaked for three concurrent 24-hour periods and at the end of each period the dimension, weight and moisture content changes were determined. Following the final soak period, the samples were dried to their original moisture content and the final weights, dimensions and moisture contents were again recorded.

Ten 2"×4"×8" samples each containing one knot were also prepared, tested and measured in exactly the same manner as the samples with the knots removed and the holes plugged and glued.

Table 25 summarizes the average measurements obtained from the pine samples. It demonstrates that in this embodiment the replacement plug responds to the water soak test in essentially the same manner as that of clear wood. At the same time, knots react quite different when exposed to the same conditions with inferior results to the replacement plugs.

The average difference between the thickness swelling of the plug and the wood surface was an absolute value of 0.035 mm, while the average difference for the samples containing knots as 2.9 times greater than 0.101 mm. This increase indicates that in these embodiments the replacement plug is much more dimensionally stable with respect to the wood surface than are knots. This study also was conducted on sitka spruce, alpine fir, western hemlock, and Douglas fir. Similar results were obtained for all 4 species.

TABLE 25

Clear Wood System
Water Soak Experiment
Measurement of Thickness Swelling

| | MC (%) | Knot (mm) | Wood (mm) | Difference (mm) |
|---|---|---|---|---|
| | | Plug vs. Wood | | |
| Original | 11.38 | 0.000 | 0.000 | 0.000 |
| 24 hr | 24.48 | 0.535 | 0.558 | 0.023 |
| 48 hr | 27.00 | 0.566 | 0.610 | 0.044 |
| 72 hr | 29.43 | 0.695 | 0.650 | 0.045 |
| Final | 11.96 | 0.221 | 0.250 | 0.029 |
| Average | | | | 0.035 |
| | | Knot vs. Wood | | |
| Original | 11.68 | 0.000 | 0.000 | 0.000 |
| 24 hr | 23.51 | 0.643 | 0.530 | 0.113 |
| 48 hr | 27.12 | 0.783 | 0.657 | 0.126 |
| 72 hr | 29.97 | 0.768 | 0.700 | 0.068 |
| Final | 11.16 | 0.100 | 0.196 | 0.096 |
| Average | | | | 0.101 |

Example 15

Strength Properties of Manufactured, Clear, Dry Lumber

Tests were conducted to compare the strength properties (MOR and MOE) of lumber with knots and clear, dry lumber treated in accordance with the invention having plugged knot holes. The material used was 2×4-inch nominal dried lodgepole pine lumber. The diameter of the knots on the knotty lumber ranged from about 24 to 30 mm (0.94 to 1.18 inches). The diameter of the hole which was bored on the wider face through the full thickness of the lumber was 1.5 inches (38.1 mm). The hole was plugged with glued wood dowel the grain direction of which was parallel to the length of the lumber. The glued dowel was bonded with catalyzed PVA adhesive. Only one knot or plugged hole was present in the test sample and was located at the centre of the piece. The samples were tested in flat bending in an Instron machine. The samples were centrally loaded on the surface nearest the pith on a span of 21 inches in such a way that a knot or plugged hole was located at mid-span. The load was applied continuously at a rate of motion of the movable crosshead of 0.10 in. (2.5 mm)/min.

The results are shown in Table 26. The samples with plugged holes exhibited greater strength properties, i.e. about 16.8% greater MOR and 11.5% greater MOE, than the samples with knots. These results may be conservative, considering that the sizes of the knots are very much smaller than that of the plugged holes. A regression analysis of the knot size versus MOR indicated that if the size of the knot was the same as that of the plugged hole, i.e. 1.5 inches, the estimated MOR of the knotty lumber was only about 5,454 psi, which was 24% lower than that of the plugged-hole lumber. These results show that the removal of the knot and plugging of the resulting hole may improve the strength properties of the lumber. Other advantages of the knot removal and plugging in alternative embodiments may include improved dimensional stability and surface appearance, reduced checking, uniformity of density and grain direction, and improved paintability and overlaying properties of the resulting surface.

TABLE 26

Comparison of the strength properties of lumber with knot and plugged hole.

| Lumber Type | Modulus of Rupture (psi) Average | Modulus of Rupture (psi) Std. Dev.* | Modulus of Elasticity (psi) Average | Modulus of Elasticity (psi) Std. Dev.* |
|---|---|---|---|---|
| With Knot | 6167 | 635 | 1007614 | 72573 |
| With Plugged hole | 7200 | 765 | 1123179 | 62831 |

*Standard Deviation

What is claimed is:

1. A method of treating a piece of lumber comprising:

a) analyzing the lumber to detect a surface defect at a site on the lumber;

b) removing at least a portion of the surface defect to form an opening in the lumber at the site of the defect;

c) drying the lumber using a process wherein moisture is allowed to escape from the lumber through the opening;

d) inserting a solid plug in the opening to refill the opening in the lumber.

2. The method of claim 1 wherein vacuum is applied in the step of drying the lumber.

3. The method of claim 2 wherein heat is applied in the step of drying the lumber.

4. The method of claim 3 wherein heat is applied by electromagnetic irradiation of the lumber.

5. The method of claim 4, wherein the plug is bonded to the opening in the lumber with an adhesive.

6. The method of claim 5 wherein the plug is made of wood and the plug is inserted so that the direction of the grain of the plug approximately matches the direction of the grain of the lumber.

7. The method of claim 6 wherein a plurality of openings are formed in the lumber and the openings are preferentially located in regions of the lumber that have a high moisture content relative to other portions of the lumber.

8. The method of claim 7 wherein the plug is cut from the lumber.

9. The method of claim 8 further comprising the step of infusing the lumber with a liquid through the opening before the plug is inserted.

10. The method of claim 9 further comprising the step of planing the plugs so that the plugs are level with a surrounding surface of the lumber.

11. The method of claim 9 further comprising the step of providing first and second pieces of lumber treated in accordance with steps (a) through (c), wherein the openings in the lumber are corresponding, further comprising joining the first and second pieces of lumber to form a composite wood product by placing the pieces of lumber together and engaging the plug in the corresponding openings.

12. The method of claim 1 further comprising the step of providing first and second pieces of lumber treated in accordance with steps (a) through (c), wherein the openings in the lumber are corresponding, further comprising joining the first and second pieces of lumber to form a composite wood product by placing the pieces of lumber together and engaging the plug in the corresponding openings.

13. A method of drying a piece of lumber comprising:

a) forming a transverse opening in the lumber bisecting water-carrying channels in the lumber;

b) drying the lumber using a process wherein moisture is allowed to escape from the lumber through the opening;

c) inserting a solid plug in the opening to refill the opening in the lumber.

14. A method of forming a composite wood product from first and second pieces of lumber, comprising:

a) forming corresponding transverse openings in the first and second pieces of lumber, each opening bisecting water-carrying channels in the piece of lumber;

b) drying the pieces of lumber using a process wherein moisture is allowed to escape from the lumber through the opening;

c) joining the pieces of lumber to form the composite wood product by placing the pieces of lumber together and engaging a plug between each of the corresponding transverse openings.

15. The method of claim 14 wherein vacuum is applied in the step of drying the lumber.

16. The method of claim 15 wherein heat is applied in the step of drying the lumber.

17. The method of claim 16 wherein heat is applied by electromagnetic irradiation of the lumber.

18. The method of claim 17 wherein the plug is bonded to the openings in the lumber with an adhesive.

* * * * *